US005359825A

United States Patent [19]

Makarov

[11] Patent Number: 5,359,825

[45] Date of Patent: Nov. 1, 1994

[54] MODULAR CONSTRUCTION SYSTEM

[75] Inventor: George D. Makarov, Chicago, Ill.

[73] Assignee: Concrete Concepts, Inc., Des Plaines, Ill.

[21] Appl. No.: 822,615

[22] Filed: Jan. 17, 1992

[51] Int. Cl.[5] ..... E04B 5/04

[52] U.S. Cl. ..... 52/602; 52/79.14

[58] Field of Search ..... 52/262, 266, 79.14, 52/227, 251, 236.6, 236.7, 79.2, 602

[56] References Cited

U.S. PATENT DOCUMENTS

| | | | |
|---|---|---|---|
| 457,984 | 8/1891 | Eastman | 52/602 X |
| 2,202,745 | 5/1940 | Muse | 52/602 X |
| 2,741,908 | 4/1956 | Swanson | 52/602 X |
| 4,136,492 | 1/1979 | Willingham | 52/79.14 X |
| 4,191,002 | 3/1980 | Rice | 52/227 X |
| 4,282,690 | 8/1981 | Meheen | 57/79.14 X |

FOREIGN PATENT DOCUMENTS

| | | | |
|---|---|---|---|
| 1078640 | 6/1980 | Canada | 52/79.14 |
| 2433089 | 4/1980 | France | 52/251 |
| 1514885 | 10/1989 | U.S.S.R. . | |

*Primary Examiner*—Carl D. Friedman
*Assistant Examiner*—Creighton Smith
*Attorney, Agent, or Firm*—Wood, Phillips, VanSanten, Hoffman & Ertel

[57] ABSTRACT

A modular construction system includes a plurality of coupled construction modules, with each module having a number of generally upright wall panels interconnected to define an enclosed interior space of preferred dimension. Construction modules are arranged in a vertical stack, with each module having a plurality of floor panels supported by the load bearing wall panels of an underlying module. Each load bearing wall panel is formed of reinforced concrete and has a pair of spaced apart L-shaped support columns. An integral lateral beam extends transversely between the support columns and has a substantially horizontal flange for supporting floor slabs of an overlying construction module. Bottom ends of the columns extend downwardly below the lower edge of the beam to define a narrow elongated trimming, whereby vertical loads associated with a supported overlying structure are transferred solely to the corners of the construction module.

5 Claims, 5 Drawing Sheets

MODULAR CONSTRUCTION SYSTEM

BACKGROUND OF THE INVENTION

1. Technical Field

The present invention relates generally to a system for constructing buildings, and more particularly toward a versatile construction system having modular building components which can be quickly assembled to create a hidden skeletal support frame for residential or commercial structures.

2. Background Art

Existing constructions frequently utilize a post-and-beam design in which massive steel girders are used to define the skeleton of a building, and in which poured concrete slabs are supported on the skeleton to define the building floors and walls. Although the steel girder-approach has been popularized due to its inherently robust nature, the approach is fraught with undesirable shortcomings which heretofore have been accepted as unavoidable compromises.

Particularly, one existing problem is the limited capability of achieving spacious, open interiors within buildings. Because the weight of overlying structure is distributed over an entire floor, in a typical post-and-beam design it is necessary to place vertical posts at regularly spaced intervals across the area spanned by the floor. Architects are required to work around the posts when designing a useful interior environment, and must concern themselves first with the structural constraints of the building, rather than the use to which the space is intended.

Additionally, costs and construction times associated with post-and-beam construction can be prohibitive. Once a steel girder-skeleton is erected, workers must continue to endure prevailing weather effects while the concrete "skin" is mounted on the skeleton. As a result, weather conditions play a large role in determining the amount of time, and the number of man hours, required to erect a building.

Post-and-beam construction also requires an enormous amount of labor and equipment to properly assemble the steel girder-skeleton and to subsequently mount the various concrete panels. In addition to the many man hours required, each floor of a post-and-beam construction requires several steel girders which necessitate the use of costly, specialized equipment. Painstaking care is necessary to properly align each of the numerous girders which are required in each floor of a building. As a result, labor and material costs can quickly become exorbitant and limit the efficiency with which a building is erected.

The present invention is directed toward overcoming one or more of the problems set forth above.

SUMMARY OF THE INVENTION

It is an object of the present invention, therefore, to provide a new and improved construction system having modular building components which can be quickly assembled to define a stable, structurally sound skeletal support frame for residential or commercial structures.

In the exemplary embodiment, the modular construction system includes a plurality of coupled construction modules, with each module having a number of generally upright wall panels interconnected to define an interior space of preferred dimension. In the contemplated form, a series of construction modules are arranged in a vertical stack, with each module having a floor panel supported by the wall panels of an underlying module.

The wall panels function as either load bearing panels, or, in the alternative, intermediate filler panels which are alternatingly connected between the load bearing wall panels to rigidify the construction module and enclose the interior space.

Each load bearing panel is formed of reinforced concrete and has a pair of integrally formed L-shaped support columns at opposite ends thereof. Bottom ends of the support columns define a panel lower edge and engage an underlying supporting surface for maintaining the walls of the construction module in a substantially vertical orientation. In the exemplary application, wherein a number of construction modules are stacked in a vertical arrangement, the column bottom ends are supported by the upper surface of the L-shaped support column on an underlying load bearing panel.

The load bearing panels also include an integral lateral beam which spans each panel and interconnects the pair of L-shaped support columns. Each lateral beam has a lower edge which is upwardly offset from the lower edge of the load bearing panel, whereby reaction forces induced by the weight of overlying modules is concentrated solely on the spaced columns, providing the building with a hidden skeletal support frame.

The load bearing panels have a substantially horizontal integral flange which extends transversely between the L-shaped support columns along the upper edge of each load bearing panel for supporting the floor panels of an overlying construction module. The load bearing wall panels of the construction module acting as a base or foundation for the resulting modular construction have an additional transverse flange near the lower wall panel edge for supporting the floor panel of the foundation construction module, and provide the building with a hidden skeletal support frame.

Each floor panel is preferably a three-ply, concrete structure having alternating layers of concrete of varying density to impede the transmission of sound between vertically stacked construction modules. Preferably, the floor panel has a relatively low density concrete layer sandwiched between two relatively high density concrete layers.

The present invention also envisions a method of fabricating a modular construction, including the step of casting a pair of concrete load bearing panels, and casting a pair of concrete filler panels of the general form discussed hereinabove. The panels can be either prefabricated and transported to a building site, or may be prefabricated at the site. The concrete is vibrated to achieve a homogeneous density of the wall panel, and the wall panels can be immersed in steam to accelerate curing of the concrete.

After the concrete panels have attained maximum hardness, the load bearing panels and the filler panels are interconnected in a substantially upright orientation to define a construction module having a closed interior space of preferred dimension. A concrete floor panel is supported on the transverse flanges of the load bearing panels, and a multiplicity of modules can be successively stacked to define a vertically extending modular construction.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and advantages, may be best understood by reference to the following description taken in conjunction with the accompanying drawings, in which like reference numerals identify like elements in the figures and in which:

DESCRIPTION OF THE PREFERRED EMBODIMENT

Figure 1:
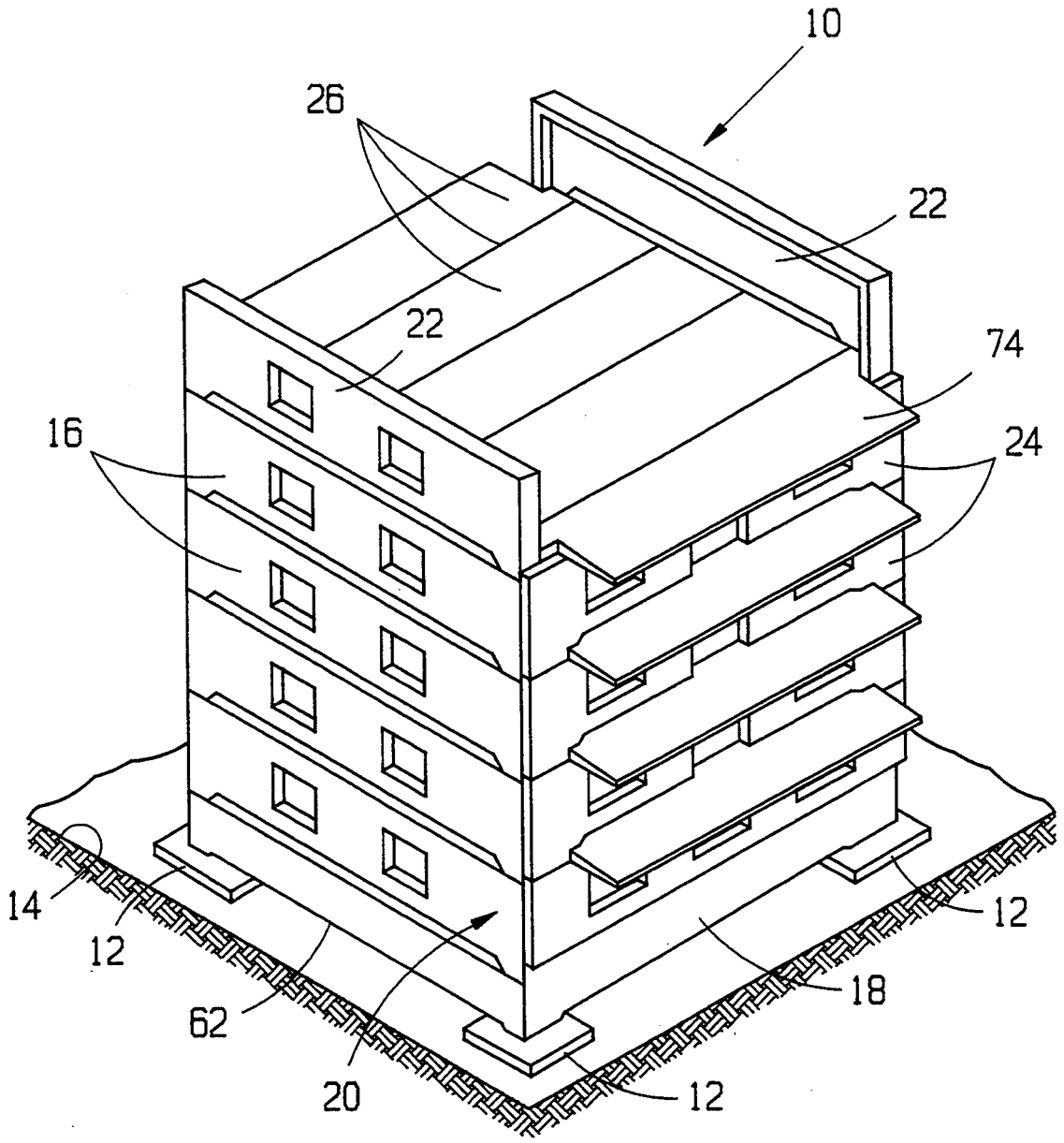
FIG. 1 is a diagrammatic illustration of a partially completed modular building which discloses the present modular construction system.

Referring to the drawings in greater detail, and first to FIG. 1, a partially completed building assembled in accordance with the present invention is shown and generally designated 10. Building 10 is suitable for use in a number of residential and commercial applications, and may be constructed, for example, for use as a hospital, an office building, an apartment complex, house or the like. The building is generally rectangular and is supported at its lowermost corners by footings 12. The footings are buried within the ground 14 for stably maintaining the building in a substantially vertical orientation in known fashion.

Building 10 is made up of a number of vertically stacked construction modules 16 which cooperate to define upwardly successive floors in the building. The bottommost construction module 18 acts as a foundation module for supporting the overlying stack of construction modules on footings 12. Foundation module 18 extends partially above ground level, whereby each of the overlying construction modules 16 are positioned above ground level.

Construction modules 16 are formed from a plurality of generally upright wall panels 20 which are interconnected to define a closed interior space of a preferred dimension.

The wall panels 20 of each construction module 16 include a pair of oppositely spaced parallel load bearing panels 22, and a pair of oppositely spaced parallel filler panels 24 (one shown in each construction module in FIG. 1) which are alternatingly connected between load bearing wall panels 22 to define a generally rectangular framework for the construction module. Floor slabs 26, as will be described below, are assembled in a coplanar juxtaposed array and supported on oppositely spaced load bearing panels 22 to define a substantially horizontal platform which provides stiffness of construction modules 16 in a longitudinal direction.

Figure 4:
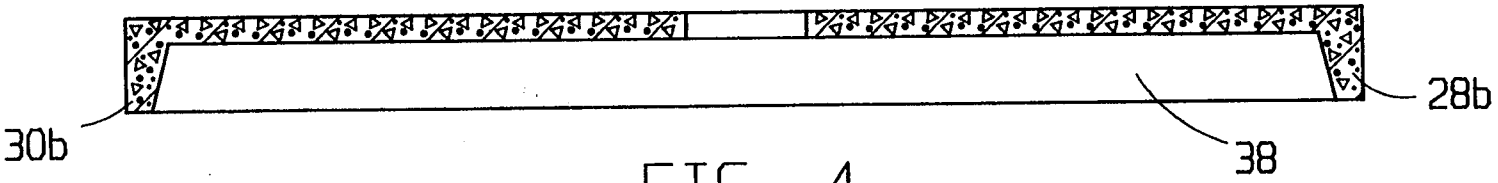
FIG. 4 is a sectional view taken along line 4—4 in FIG. 2.
Figure 3:
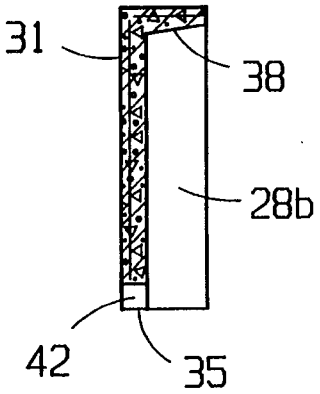
FIG. 3 is a sectional view taken along line 3—3 in FIG. 2.
Figure 2:
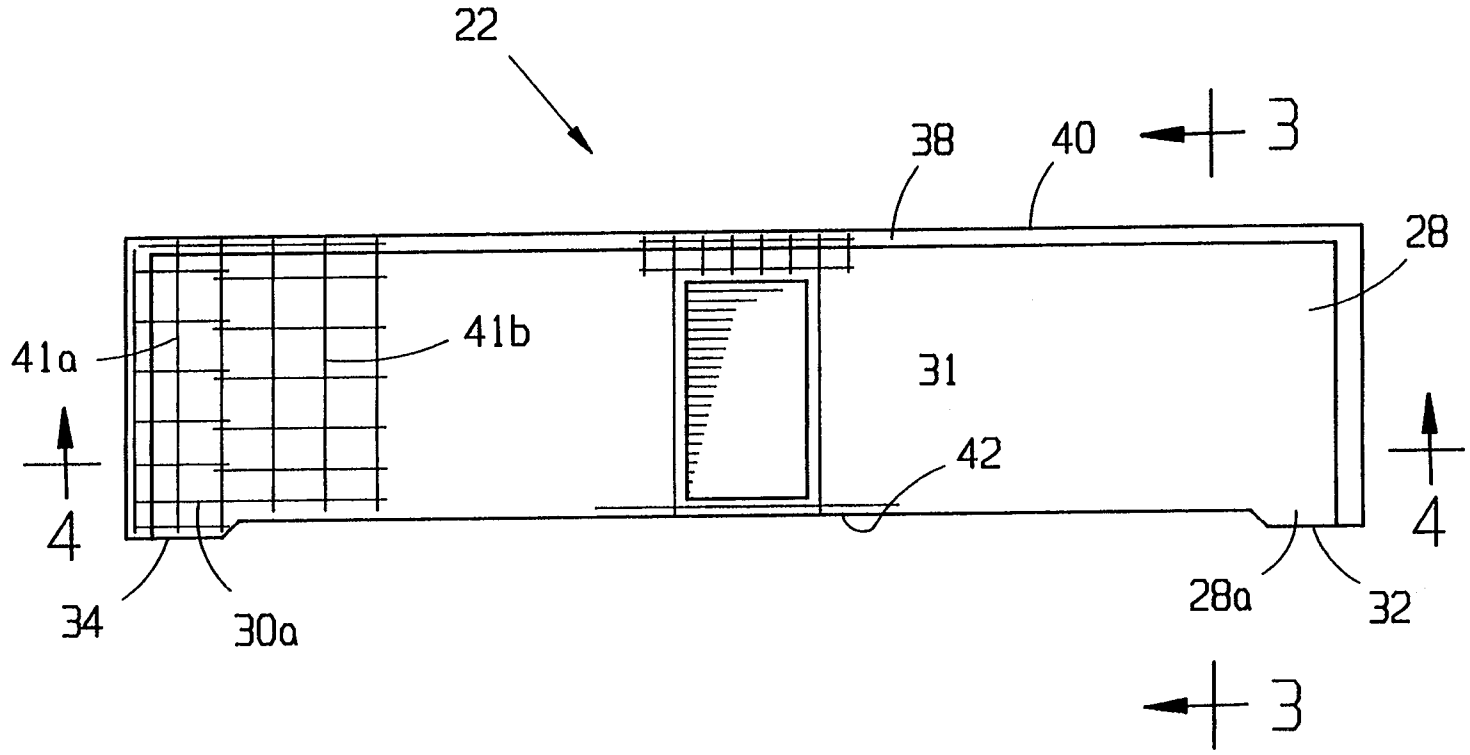
FIG. 2 is a front elevational view of a load bearing wall panel partially broken away to show an embedded reinforcing mesh.

Referring to FIGS. 2–4 in conjunction with FIG. 1, each load bearing wall panel 22 has a pair of generally L-shaped support columns 28 and 30 interconnected by a laterally extending integral beam 31. L-shaped support columns 28 and 30 have bottom column ends 32 and 34, respectively, which are engageable with an underlying supporting surface for maintaining the wall panel in a substantially vertical orientation. A flange 38 projects from each load bearing wall panel 22 and extends transversely along an upper edge 40 of the load bearing wall panels between support columns 28 and 30. The flange 38 increases the stiffness of construction modules 16 in a longitudinal direction and allows the span of floor slabs 26 to be reduced in size.

Load bearing wall panels 22 are formed of cast concrete. Support columns 28 and 30 are reinforced by means of an embedded metal mesh **41*a* which is designed to carry the load of its own weight to facilitate the transportation and erection of the wall panels, and further to carry the load of the upper modules and all additional weight associated with a functional building. Integral beam 31 is reinforced with metal mesh 41*b*. Mesh 41*b* is designed to carry its own weight to facilitate the transportation and erection of the wall panels, and carries the weight of floor panels 26** of only an immediately overlying construction module.

In a preferred embodiment of the invention, the substantially perpendicular legs **28*a*, 28*b* and 30*a*, 30*b* of the L-shaped support columns 28 and 30, respectively are between twenty and twenty-eight inches in width and are approximately six inches thick and equal to the height of the floor. Transverse flange 38 preferably is approximately four inches thick and projects in a direction substantially perpendicular to beam 31 a distance equivalent to the width of the legs 28*b* and 30*b* of generally L-shaped columns 28 and 30. Integral beam 31** may include any number of desirably located window and door openings, and can span a length ranging between approximately twenty to sixty feet.

As shown in FIG. 2, bottom column ends 32 and 34 define a lower wall panel edge 35 having a width of from forty to fifty-six inches for supporting load bearing wall panel 22. Integral beam 31 has a lower edge 42 which is upwardly offset from wall panel lower edge 35. In the preferred embodiment, lower beam edge 42 is upwardly offset approximately one inch from the lower wall panel edge to define an elongated narrow opening or trimming immediately subjacent the beam edge 42.

When interconnected in an alternating arrangement to define construction modules 16, load bearing wall panels 22 distribute all the load which is supported by the panels, such as the weight of overlying construction modules when the modules are stacked, onto the end columns 28 and 30 due to the arrangement of lower edge 42 on the integral beam 31. As a result, reaction forces exerted by a supporting surface in response to the weight of a structure supported on the surface, are concentrated solely on L-shaped columns 28 and 30. In a multi-story construction, in which a number of construction modules are vertically stacked, the weight of the entire building is carried by the columns, as opposed to distributing the weight over the entire width of the load bearing panels.

The load bearing wall panels advantageously may be fabricated at a building site or pre-cast at a manufacturing facility and subsequently transported to a construction site. When the load bearing wall panels, as well as the intermediate filler panels and the floor panels, are prefabricated, early-strength additives may be mixed in with the concrete in appropriate forms to shorten the time required for the concrete to cure and dry. The poured components are then vibrated, such as by known vibrating tables or platform vibrators, to achieve a uniform density in the resulting structures. In order to accelerate the curing of the concrete, the forms may be immersed in a steam bath, whereby the concrete may attain 70 percent maximum hardness in approximately 7 hours.

Figure 5:
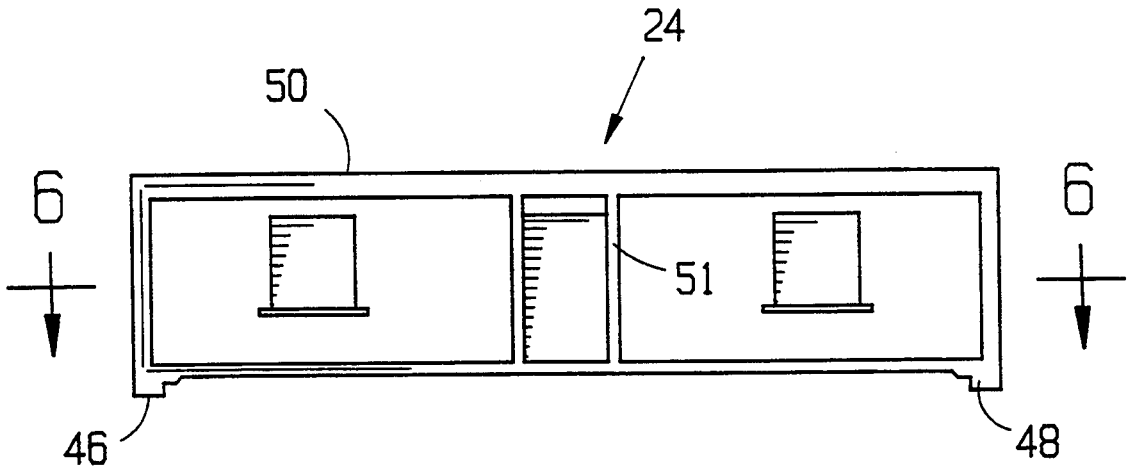
FIG. 5 is a front elevational view of a filler wall panel.
Figure 6:
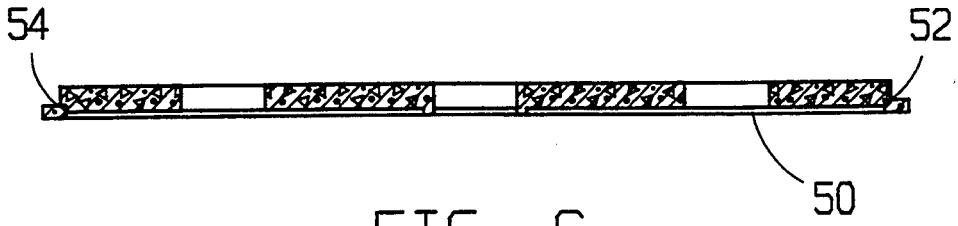
FIG. 6 is a sectional view taken along line 6—6 in FIG. 5.

Filler panels 24 (see also FIGS. 5 and 6) are non-load bearing, generally rectangular concrete panels having oppositely spaced legs 46 and 48 with lengths of twenty-five inches each. As with the load bearing panels, an elongated narrow trimming extends along the entire length of panel 24 between legs 46 and 48. The design of the legs and trimming results in the panel functioning as a beam-wall with a height equal to the height of the floor.

Similar to load bearing wall panels 22, the filler wall panels may have any number of cast window and door openings. Filler wall panels 24 range in length from twenty to forty feet and, in the preferred form, are approximately fourteen inches thick. A stiffening flange 50 extends around the perimeter of each filler panel 24 and projects approximately two inches from the outer face of the panels. A stiffening flange 51 with a width of approximately six inches is also formed around the periphery of door openings in the filler panels to enhance the structural integrity of the resulting construction module.

Figure 7:
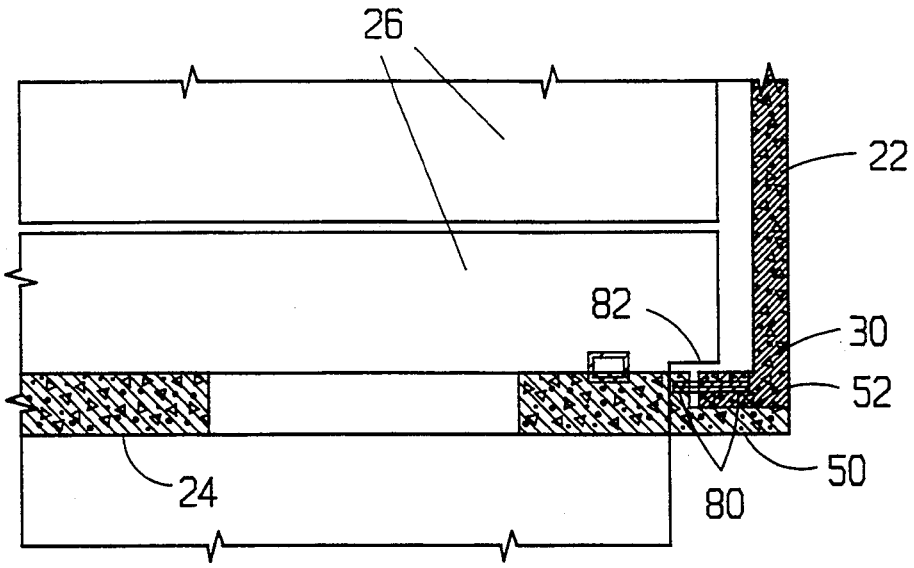
FIG. 7 is an enlarged fragmentary sectional view illustrating the connection between a load bearing wall panel and a filler wall panel.

Referring also to FIG. 7, a pair of stepped vertical notches 52 and 54 are formed at the opposite ends of each filler panel 24 and extend along the entire height of the panels to facilitate the interconnection of the filler panels with load bearing panels 22. Specifically, L-shaped columns 28 and 30 on the load bearing wall panels nest within stepped notches 52 and 54 (shown with respect to notch 52 and L-shaped column 30 in FIG. 7) at opposite ends of the filler panels to reinforce the rigidity of the resulting connections between the wall panels.

Figure 8:
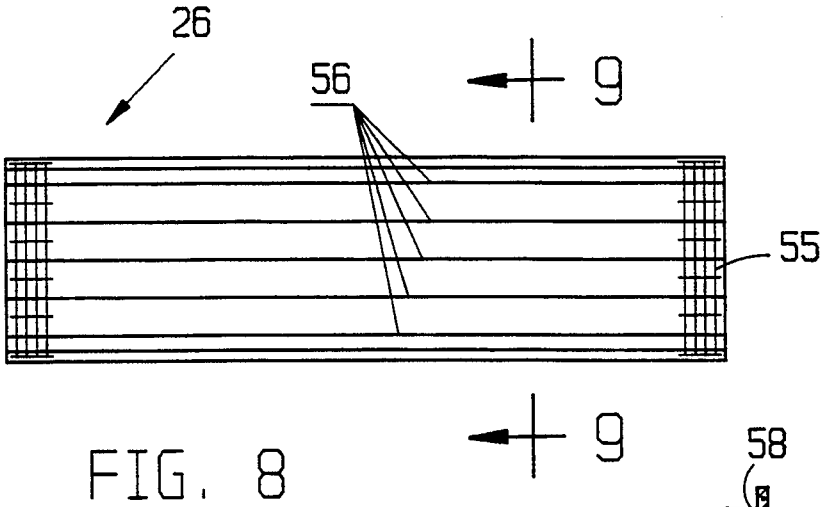
FIG. 8 is a sectional view illustrating a multi-ply floor slab construction partially broken away to show a reinforcing mesh.

Floor panels 26, illustrated in FIG. 8, have a sandwich construction and comprise generally rectangular three-ply concrete slabs reinforced with a metal mesh 55. The alternating concrete layers have varying densities, with the layers being arranged to impede the transmission of sound between vertically stacked construction modules. Particularly, the present invention envisions a three-ply floor panel 26 having a relatively low density concrete layer 58 sandwiched between a pair of relatively high density one and one-half inch thick concrete layers 60. The slabs are reinforce by prestressed steel bars 56 which are arranged in the bottommost layer 60. The cross-sectional area and number of bars 56 which are used are computed as a function of the predicted load levels and the span of the slabs 26. The reinforcement bars 56 are prestressed using a generally known electrothermal method. The slab ends are reinforced with the spaced reinforcing meshes 55 which are disposed beneath the prestressed steel bars 56.

Figure 9:
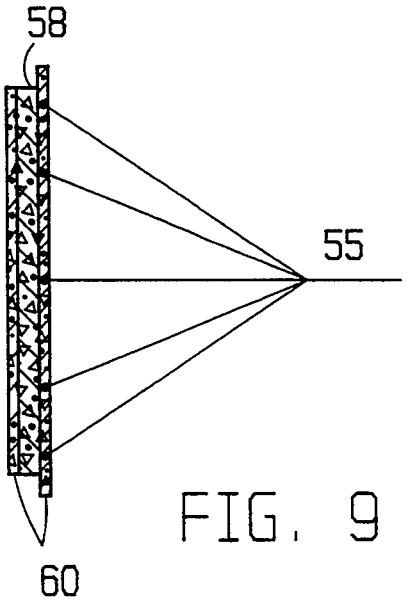
FIG. 9 is a sectional view taken along line 9—9 in FIG. 8.
Figure 11:
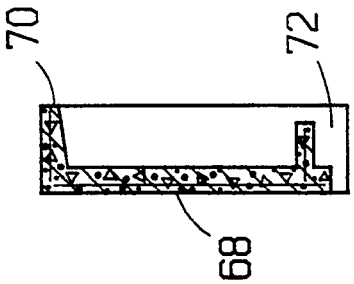
FIG. 11 is a sectional view taken along line 11—11 of FIG. 10.
Figure 10:
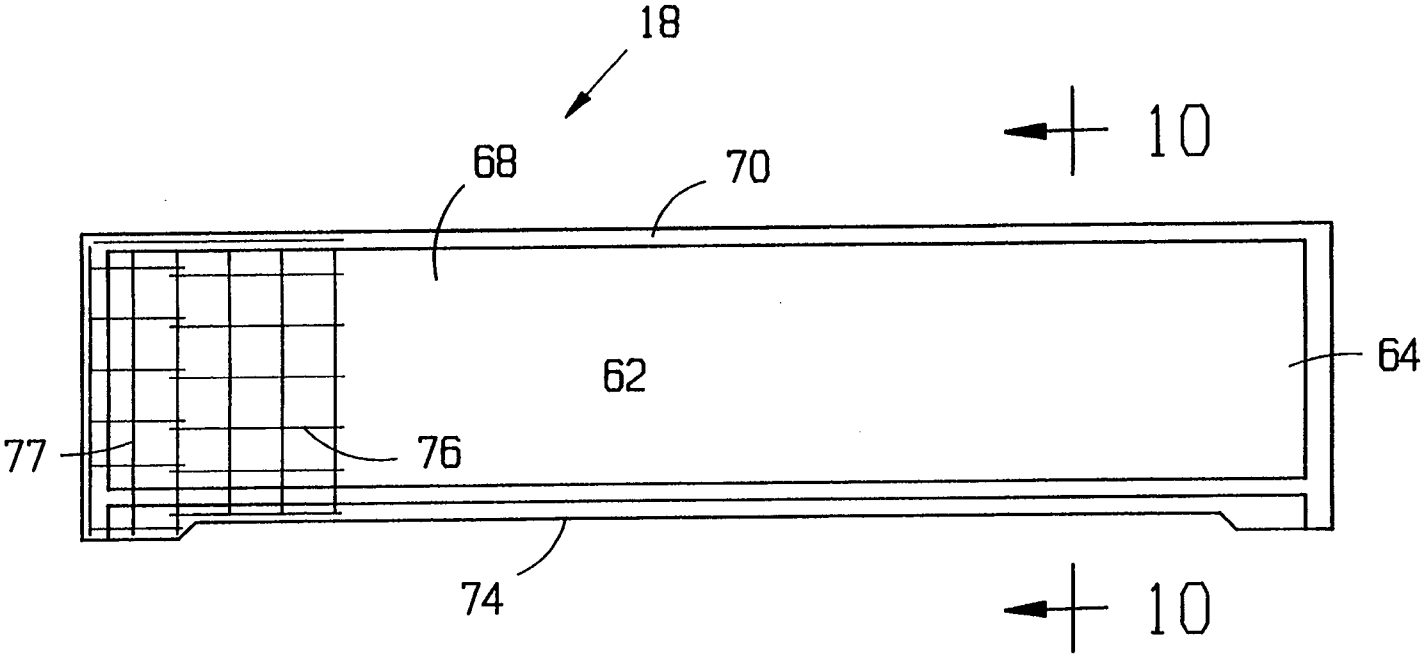
FIG. 10 is a front elevational view of a load bearing foundation wall panel partially broken away to show an embedded reinforcing mesh.

Referring again back to FIG. 1, it should be understood that foundation module 18 has a generally similar construction to the overlying construction modules 16. However, as illustrated in FIGS. 9 and 10, foundation module 18 has a pair of oppositely spaced parallel load bearing panels 62 (one shown in FIG. 9), with each panel 62 having a pair of spaced apart generally L-shaped columns 64 and 66 connected by an integral beam 68. Similar to the load bearing wall panels 22 discussed above, a substantially horizontal flange 70 extends transversely along the upper edge of load bearing foundation panel 62 between columns 64 and 66. In addition, for purposes to be discussed hereafter, an intermediate flange 72 extends transversely between columns 64 and 66 along the lower edge 74 of integral beam 68. Similar to load bearing wall panels 22, load bearing foundation panel 62 is formed of pre-cast concrete and includes an embedded reinforcing mesh 76 and 77.

The manner in which load bearing panels 22 and filler panels 24 are joined to form a stable, self-supporting structure will now be discussed.

In addition to the stabilizing function provided by the stepped notches 52 and 54 (see FIGS. 6 and 7), adjacent wall panels 20 can be rigidly joined by means of flat metal insertion elements 80 (FIG. 7) set in the concrete wall panels during manufacture thereof, whereby when the wall panels are assembled in a rectangular array, the inserts on adjacent wall panels are abutted with each other. Splice plates 82 are welded across a pair of abutted insertion elements 80 to rigidly secure the adjacent wall panels. An overlying layer of cement or mortar can be used to conceal the splice plates 82 from view once the panels are connected.

It should be understood that a variety of methods may be used for connecting the panels, and the insert element and splice plate technique shown here comprises but one alternative method.

While only two insertion elements are shown in FIG. 7 for horizontally joining a load bearing wall panel to a filler panel, it is understood that complementary pairs of mating insertion elements are spaced along the side edges, including the upper and lowermost extremes of the side edges of the wall panels during manufacture to facilitate not only the horizontal interconnection of adjacent wall panels, but also the successively upward connection of stacked construction modules. In addition, a layer of concrete is provided between a pair of construction modules to fill any imperfections which may exist in the mating wall panel edges and to insure proper alignment of the superposed modules.

It is believed that the manner in which modular structure 10 is assembled can be understood from the foregoing and may be summarized as follows.

Initially, concrete footings 12 are poured or set in place and located a preferred distance below ground level 14. Foundation module 18 is then assembled by interconnecting foundation load bearing panels 62. L-shaped support columns 64 and 66 on the load bearing panels are placed directly on the footings to provide a stable platform upon which the remaining construction modules are successively stacked.

A plurality of abutting floor panels 26 are interconnected in the manner described above to define a planar support platform. That is, each floor panel 26 includes a number of edge-mounted metal insertion elements which are joined together, as by a welded splice plate, to rigidly interconnect the panels. The support platform is then rested on intermediate flanges 72 of the opposite load bearing foundation panels 62 to define a floor within foundation module 18. A similar planar support platform formed of a multiplicity of interconnected floor panels 26 is mounted across the upper flanges 70 on load bearing panels 62 to define a floor for the next successively stacked construction module 16. Each support platform is joined to the transverse flanges 70 and 72 on the peripheral wall panels 20 by the insertion element/splice plate technique described above. The endmost floor panels can be formed to extend outwardly beyond the wall panels 20 for supporting a decorative facade, balcony, or similar aesthetic exterior building treatment. An exterior flange or tongue may also be provided on the load bearing panels or filler panels to serve as a frame upon which exterior decorative facades are supported.

Once foundation module 18 is assembled, pairs of load bearing panels 22 and intermediate filler panels 24 are interconnected to form construction modules 16 which, in turn, are successively stacked on the floor panels of the underlying modules.

The "first floor" of modular structure 10 is formed by stacking a construction module 16 on the floor panels 26 supported on the load bearing panels of foundation module 18. A coplanar array of interconnected floor panels 26 is then supported on the transverse flanges 38 on load bearing panels 22 to define a floor for the "second floor" of modular structure 10. As previously discussed, the endmost floor panels 26 of an interconnected array can be formed to extend outwardly beyond the wall panels 20 to define a tongue 74 for supporting a decorative facade or similar aesthetic exterior building treatment. Construction modules 16 are successively stacked until the resulting structure reaches a desired height. Each load bearing panel and filler panel has a height which is substantially equal to the height of the floor, and the interconnected panels together define a self-stabilized, free standing structure. Once the desired building height is attained, suitable roofing structure of a generally known type is secured to the upper most construction module 16.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A modular wall panel for use in a structure having vertically stacked construction modules wherein each module includes a plurality of upright wall panels and at least one substantially horizontal floor panel, the wall panel comprising:

a pair of spaced apart upright columns each having first and second mutually perpendicular legs, said first and second legs having lower ends which collectively define a bottom edge of the wall panel;

a beam integral with and extending between the first legs of said columns, said first and second legs having upper ends which together with the beam define an upper edge on the wall panel for supporting a wall panel of an overlying construction module; and a substantially horizontal flange integral with and extending between said second legs transversely of the beam along said wall panel upper edge for supporting a floor panel of an overlying construction module;

the second legs of said columns having a width characterized by the distance which said second legs project transversely from the beam and in which said flange has a width characterized by the distance which said flange projects transversely from the beam, the width of said second legs being substantially equal to the width of said flange.

2. A modular wall panel for use in a structure having vertically stacked construction modules wherein each module includes a plurality of upright wall panels and at least one substantially horizontal floor panel, the wall panel comprising:

a pair of spaced apart upright columns each having first and and second mutually perpendicular legs, said first and second legs having lower ends which collectively define a bottom edge of the wall panel;

a beam integral with and extending between the first legs of said columns, said first and second legs having upper ends which together with the beam define an upper edge on the wall panel for supporting a wall panel of an overlying construction module; and a substantially horizontal flange integral with and extending between said second legs transversely of the beam along said wall panel upper edge for supporting a floor panel of an overlying construction module;

a substantially horizontal flange integral with and extending between said second legs transversely of the beam between said bottom edge and said upper edge for supporting a floor panel of a construction module in which the wall panel is used.

3. A modular construction system having a number of vertically stacked construction modules, each module comprising a plurality of upright wall panels connected together to define an interior space having a preferred dimension, and at least one floor panel supported by the wall panels of an underlying construction module, the wall panels including load bearing panels and filler panels, said load bearing wall panels comprising;

a pair of spaced apart upright columns each having first and second mutually perpendicular legs, said first and second legs having lower ends which collectively define a bottom edge of the wall panel;

a beam integral with and extending between the first legs of said columns, said first and second legs having upper ends which together with the beam define an upper edge on the wall panel for supporting a wall panel of an overlying construction module; and a substantially horizontal flange integral with and extending between said second legs transversely of the beam along said wall panel upper edge for supporting a floor panel of an overlying construction module;

a load bearing wall panel in each of said vertically stacked modules having a beam lower edge upwardly offset from the lower edge of said wall panel to define a series of vertically aligned spaces between the beam of each module and a floor panel supported on an underlying module whereby vertical forces acting on the construction system are reacted only at the columns;

the floor panel being a multi-ply concrete structure having alternating layers of concrete of varying density to impede the transmission of sound between said vertically stacked modules.

4. The modular construction system of claim 3 in which the floor panel has a relatively low density concrete layer sandwiched between two relatively high density concrete layers.

5. A modular construction system having a number of vertically stacked construction modules, each module comprising a plurality of upright wall panels connected together to define an interior space having a preferred dimension, and at least one floor panel supported by the wall panels of an underlying construction module, the wall panels including load bearing panels and filler panels, said lead bearing wall panels comprising;

a pair of spaced apart upright columns each having first and second mutually perpendicular legs, said first and second legs having lower ends which collectively define a bottom edge of the wall panel;

a beam integral with and extending between the first legs of said columns, said first and second legs having upper ends which together with the beam define an upper edge on the wall panel for supporting a wall panel of an overlying construction module; and a substantially horizontal flange integral with and extending between said second legs transversely of the beam along said wall panel upper edge for supporting a floor panel of an overlying construction module;

a load bearing wall panel in each of said vertically stacked modules having a beam lower edge upwardly offset from the lower edge of said wall panel to define a series of vertically aligned spaces between the beam of each module and a floor panel supported on an underlying module whereby vertical forces acting on the construction system are reacted only at the columns;

the wall panels being formed of concrete and at least one of the wall panels and the floor panel having an outwardly extending tongue for supporting external building treatments.

* * * * *